US008398260B2

(12) United States Patent
Fan

(10) Patent No.: US 8,398,260 B2
(45) Date of Patent: Mar. 19, 2013

(54) HEAT-DISSIPATION STRUCTURE OF LED LAMP

(75) Inventor: Jia-Hua Fan, Huang Jiang Town (CN)

(73) Assignee: Fong Kai USA, Inc., Carrollton, TX (US)

( * ) Notice: Subject to any disclaimer, the term of this patent is extended or adjusted under 35 U.S.C. 154(b) by 98 days.

(21) Appl. No.: 13/015,908

(22) Filed: Jan. 28, 2011

(65) Prior Publication Data

US 2011/0192586 A1 Aug. 11, 2011

(51) Int. Cl.
*F21V 7/20* (2006.01)

(52) U.S. Cl. ..... 362/218; 362/217.04

(58) Field of Classification Search ..... 362/217.01, 362/218, 219, 225, 217.02, 217.1–217.17, 362/217.04, 249.01, 249.02
See application file for complete search history.

(56) References Cited

U.S. PATENT DOCUMENTS 5,541,823 A * 7/1996 Fallon et al. ..... 362/219
7,572,027 B2 * 8/2009 Zampini et al. ..... 362/225
7,997,770 B1 * 8/2011 Meurer ..... 362/311.02
2004/0001344 A1 * 1/2004 Hecht ..... 362/555
2005/0270774 A1 * 12/2005 Pan ..... 362/217
2008/0037239 A1 * 2/2008 Thomas et al. ..... 362/92
2009/0296381 A1 * 12/2009 Dubord ..... 362/218
2009/0323342 A1 * 12/2009 Liu ..... 362/249.02
2010/0328947 A1 * 12/2010 Chang et al. ..... 362/249.02
2011/0176297 A1 * 7/2011 Hsia et al. ..... 362/217.1
2012/0188756 A1 * 7/2012 Kokoski et al. ..... 362/217.05

* cited by examiner

*Primary Examiner* — Julie Shallenberger
(74) *Attorney, Agent, or Firm* — Howison & Arnott, L.L.P.

(57) ABSTRACT

A heat-dissipation structure of an LED lamp is disclosed. The LED lamp includes a metal profile, a lampshade attached to the metal profile from bottom, a lamp head mounted around the combined lampshade and metal profile, a printed circuit board set in receiving recesses bilaterally formed below the metal profile, and LEDs provided on a surface of the printed circuit board facing the lampshade. The heat-dissipation structure is characterized in a downward-bending accurate profile of the metal profile being formed between the receiving recesses, and two pads being each positioned between the flanges and the printed circuit board, the two pads serving to prop two lateral sides of the printed circuit board upward such that the printed circuit board fits the accurate profile and closely contacts the metal profile with increased contacting area. Thereby, the printed circuit board can have heat accumulated in operation rapidly dissipated from the metal profile.

3 Claims, 2 Drawing Sheets

HEAT-DISSIPATION STRUCTURE OF LED LAMP

CROSS-REFERENCE TO RELATED APPLICATIONS

This application claims benefit of Chinese Application Serial No. 201020109992.9, filed Jan. 30, 2010 entitled HEAT-DISSIPATION STRUCTURE OF LED LAMP, the specification of which is incorporated herein by reference in its entirety.

TECHNICAL FIELD

The present invention relates to lighting devices, and more particularly, to a heat-dissipation structure of an LED lamp.

BACKGROUND

An LED, as a lighting element, has the advantages of low power, high lighting efficiency, favorability to energy conservation, long service life, and avoidance of pollution, so is extensively used in our daily life. By connecting a plurality of LEDs in parallel or in series, an LED tubular lamp can be constructed for lighting purpose. Such LED tubular lamp saves more energy as compared with the conventional fluorescent lamps, and thus gradually substitutes for the latter. LEDs generate heat when operating, and therefore the lamp composed of plural LEDs is likely to have highly accumulated heat during lighting. The accumulated heat, when not dissipated timely, can cause light attenuation and decrease lighting efficiency and illumination of the LEDs.

A conventional energy-saving LED tubular lamp is depicted in FIGS. 1 and 2. It comprises a lamp head 1 mounted around a lampshade 2 and a metal profile 5 that have been combined. The metal profile 5 is a hollow extrusion, and the lampshade 2 is attached to its bottom. The combined lampshade 2 and metal profile 5 enclose a printed circuit board 3, which has a bottom facing the lampshade 2 provided with a plurality of LEDs 4, and is inlaid to receiving recesses 51 formed by a pair of flanges 512 bilaterally formed at a bottom of the metal profile 5.

In the foregoing conventional energy-saving LED tubular lamp, the printed circuit board 3 is installed between the receiving recesses 51 of the metal profile 5. The heat generated by the LEDs in operation is on one hand dissipated through the lampshade 2, and on the other hand transferred to the printed circuit board 3 to be then transferred to the entire metal profile 5 through a binding surface 511 of the metal profile 5 that closely contacts the printed circuit board 3, so that the heat generated by the LEDs can dissipated. However, in practical applications, since the lampshade and the metal profile are combined in a closed manner and the lampshade is made of a material with low thermal conductivity, e.g. plastic, the heat generated by the LEDs in operation is likely to be accumulated inside the lampshade and can only conductively dissipated outside the lamp though the contact between the printed circuit board 3 and the metal profile 5. Theoretically, the metal profile is made of a high thermal conductive and dissipating material that serves to dissipate the heat generated by the LEDs from the printed circuit board. However, in the conventional heat-dissipation structure of the LED lamp, the printed circuit board 3 is positioned below the metal profile 5 and only supported by the two flanges 512 of the metal profile 5 to be held in the receiving recesses 51. Thus, by gravity, the printed circuit board 3 is unlikely to remain in close contact with the binding surface 511 of the metal profile 5. As a result, the real thermal conductive area is limited to the very small surfaces of the flanges 512 of the metal profile for propping up the printed circuit board. This significantly reduces the possibility of greatly and rapidly dissipating heat through the contact between the printed circuit board 3 and the metal profile 5. In addition, since the printed circuit board has its bottom provided with the plural LEDs, under the double load from the weight and the gravity, the printed circuit board has to be made with a proper thickness, so the conventional printed circuit board is typically as thick as 0.8 mm. Nevertheless, a printed circuit board of such thickness is unfavorable to heat transmission and thus has inferior heat dissipation efficiency, causing the LEDs to have gradually lowered light efficiency and premature aging. All these reasons bring difficulties to extensive applications of the conventional LED tubular lamp.

SUMMARY

In order to remedy the problem related to heat dissipation with the conventional energy-saving LED tubular lamp, the present invention provides a heat-dissipation structure of an LED lamp. The energy-saving LED tubular lamp, in respect of its appearance, includes also a metal profile as a hollow extrusion, a lampshade attached to the metal profile from bottom, and a lamp head mounted around the combined lampshade and metal profile. In respect of the internal structure of the LED lamp, a printed circuit board is also inlaid receiving recesses formed by a pair of flanges bilaterally provided at a bottom of the metal profile. The printed circuit board is has a surface facing the lampshade provided with a plurality of LEDs. The heat-dissipation structure of the present invention is characterized in: a downward-bending arcuate profile of the metal profile being formed between the receiving recesses at two lateral sides of the metal profile; and a pair of pads being each positioned between the flange below a respective said receiving recess and the printed circuit board, the two pads serving to prop two lateral sides of the printed circuit board upward such that the printed circuit board fits the accurate profile and closely contacts the metal profile.

In the heat-dissipation structure of the LED lamp according to the present invention, since the printed circuit board closely fits the accurate profile of the metal profile, the contacting area there between is increased, and thus the present invention has much better heat-dissipation efficiency as compared with the conventional LED tubular lamp wherein only the small contacting area provided by a pair of flanges below bilateral receiving recesses.

In the heat-dissipation structure of the LED lamp according to the present invention, the printed circuit board has its two lateral sides propped by the pads to closely contact the accurate profile of the metal profile, and thus is enabled to resist influence caused by the gravity and the weight of the LEDs, so the thickness of the printed circuit board can be lowered to 0.4 mm. The reduced thickness improves the heat-dissipation capability so the printed circuit board perfumes better heat-dissipation effect as compared with the traditional 0.8 mm printed circuit boards.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION

Figure 1:
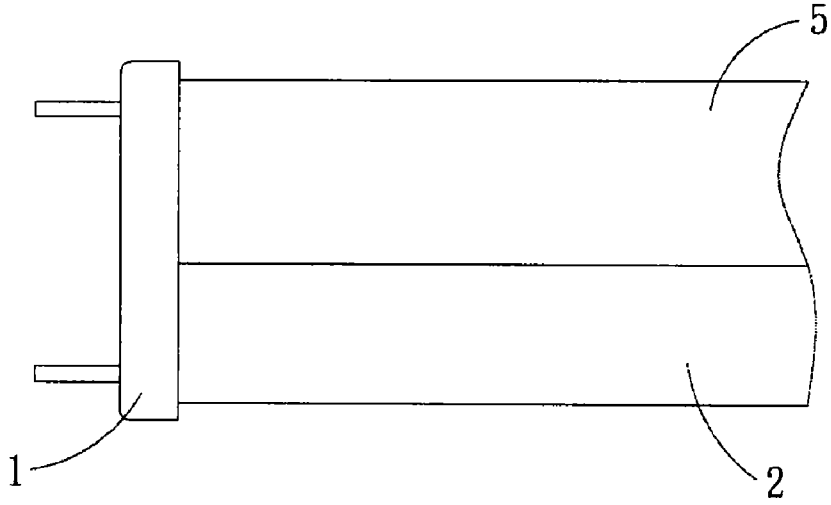
FIG. 1 is a schematic external view of a conventional LED lamp.
Figure 2:
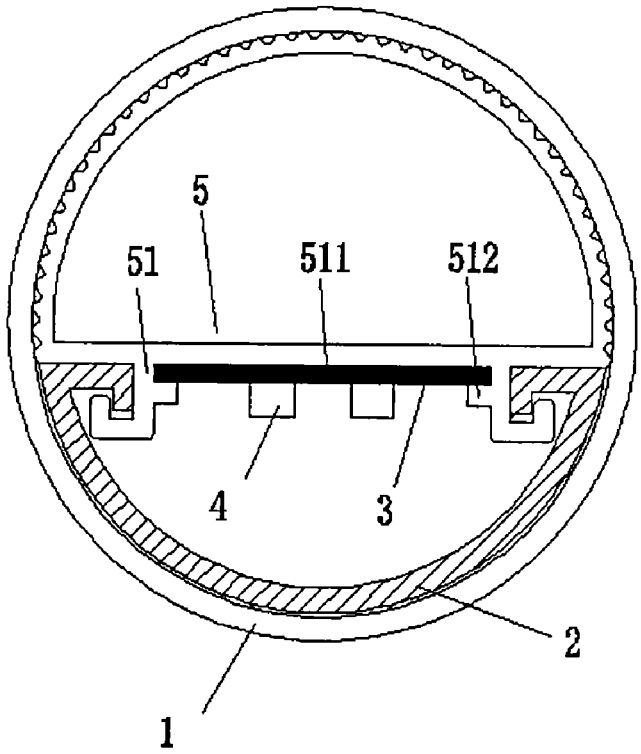
FIG. 2 is a cross-sectional view of the conventional LED lamp.
Figure 3:
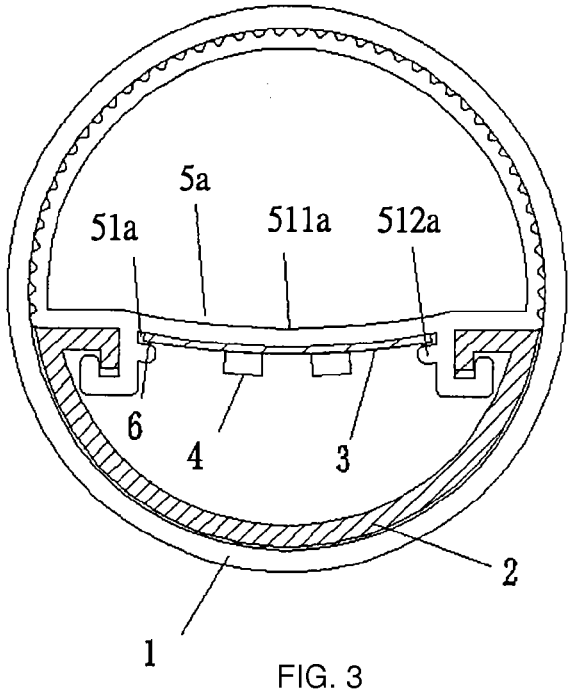
FIG. 3 is a racially cross-sectional view of a heat-dissipation structure of an LED lamp according to one preferred embodiment of the present invention.
Figure 4:
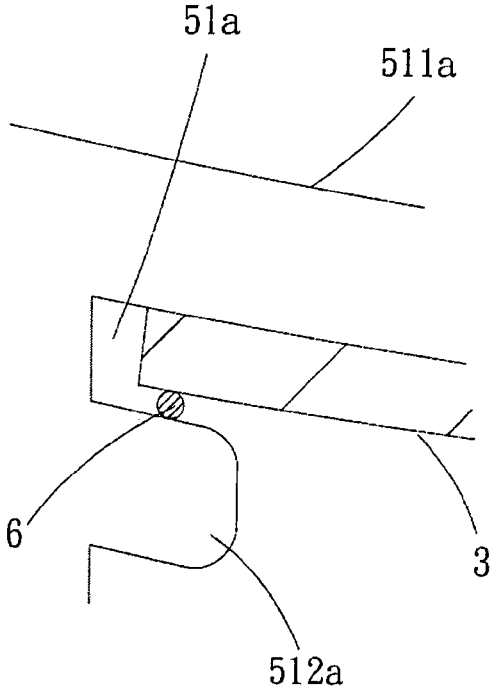
FIG. 4 is a partially enlarged view of FIG. 3, showing a printed circuit board propped up by a pad.

Please refer to FIGS. 3 and 4 for a heat-dissipation structure of an LED lamp according to one preferred embodiment of the present invention. Therein, the LED lamp is a conventional LED tubular lamp as shown in FIGS. 1 and 2, with an external structure composed of a metal profile 5*a* as a hollow extrusion, a lampshade 2 attached to the metal profile 5*a* from bottom, a lamp head 1 mounted around the combination of the lampshade 2 and the metal profile 5*a*. Inside the LED lamp, a printed circuit board 3 has one side provided with a plurality of LEDs 4 and is inserted to and thus positioned by receiving recesses 51*a* formed by a pair of flanges 512*a* bilaterally formed below the metal profile 5*a*. The heat-dissipation structure of the LED lamp according to the preferred embodiment of the present invention features that a downward-bending arcuate profile 511*a* is formed between the receiving recess 51*a* bilaterally formed below the metal profile 5*a*, and a pad 6 is set in each said receiving recess 51*a* contacting a bottom of the printed circuit board 3.

In the aforementioned heat-dissipation structure of the LED lamp according to the preferred embodiment of the present invention, after the printed circuit board 3 is inlaid into the receiving recesses 51 below the metal profile 5, the pads 6 deposited between the flanges 512*a* below the receiving recesses 51*a* and the bottom of the printed circuit board 3 serve to prop upward two lateral sides of the printed circuit board 3, so that the printed circuit board 3 fits arcuate profile 511*a* of the metal profile 5 and closely contacts the metal profile 5*a*. Thereby, since the printed circuit board closely contacts the accurate profile of the metal profile, the contacting area there between is increased. As a result, the operating heat generated by the LEDs on the printed circuit board can be rapidly and effectively transferred to and dissipated by the metal profile in virtue of the close and large-area contact, thereby achieving optimal heat-dissipation effect.

Additionally, in the aforementioned heat-dissipation structure of the LED lamp according to the preferred embodiment of the present invention, since the printed circuit board 3 has its two sides pressed by the pads 6 to abut against and closely contact the arcuate profile 511*a* of the metal profile 5, it is enabled to resist influence caused by the gravity and the weight of the LEDs, so the thickness of the printed circuit board can be lowered to 0.4 mm. The reduced thickness helps to improve the heat-dissipation efficiency. Thus, the printed circuit board of the present invention performs much better heat-dissipation capability as compared with the traditional 0.8 mm printed circuit boards.

While the pads 6 for propping up the printed circuit board 3 each have a round sectional shape in the present embodiment, other shapes may be used to realize the pads 6. Each said pad 6 may be any object of any shape that are able to forcedly prop up the corresponding side of the printed circuit board, including a block-like or bar-like object of a geometric or non-geometric shape.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A heat-dissipation structure of the LED lamp, the LED lamp including a metal profile as a hollow extrusion, a lampshade attached to a bottom portion of the metal profile, a lamp head mounted around the combined lampshade and metal profile, wherein a pair of flanges are bilaterally formed on the bottom portion of the metal profile and each said flange and the bottom portion of the metal profile jointly define a receiving recess and a pair of receiving slots at two lateral sides of the metal profile, in which receiving recess a printed circuit board is inlaid, the printed circuit board having a first side provided with a plurality of LEDs facing downward toward the lampshade, the heat-dissipation structure including:

a downward-bending arcuate surface of the metal profile being formed between the receiving slots at two lateral sides of the metal profile for contacting a second upward facing side of the printed circuit board opposite the first side of the printed circuit board; and a pair of pads being each positioned between the flange associated with a respective said receiving slot and the first side of printed circuit board, the pair of pads serving to prop two lateral sides of the printed circuit board upward such that the second upward facing side of the printed circuit board fits against the arcuate surface of the metal profile.

2. The heat-dissipation structure of claim 1, wherein the pad is a block-like or bar-like object of a geometric or non-geometric shape.

3. The heat-dissipation structure of claim 2, wherein the printed circuit board has a thickness of 0.4 mm.

* * * * *